United States Patent [19]

Vanchot

[11] 4,164,821

[45] Aug. 21, 1979

[54] SNOW PLOW BLADE ATTACHMENT SYSTEM

[76] Inventor: Andre H. Vanchot, 65 Marshall La., Derby, Conn. 06418

[21] Appl. No.: 850,688

[22] Filed: Nov. 11, 1977

[51] Int. Cl.[2] ..... E02F 3/76

[52] U.S. Cl. ..... 37/141 R; 172/719; 172/751

[58] Field of Search ..... 172/719, 753, 751, 749, 172/750, 767; 37/141 R

[56] References Cited

U.S. PATENT DOCUMENTS

| | | | |
|---|---|---|---|
| 841,530 | 1/1907 | Johnson | 172/751 X |
| 885,019 | 4/1908 | Conley | 172/753 |
| 1,741,933 | 12/1929 | Gunnison | 172/719 X |
| 1,744,139 | 1/1930 | Patton | 172/767 |
| 1,885,231 | 11/1932 | Chong | 172/751 X |
| 2,189,745 | 2/1940 | Johnson | 172/767 |
| 2,254,011 | 8/1941 | Kernodle | 172/753 |
| 2,674,052 | 4/1954 | Newkirk | 172/753 |
| 3,202,226 | 8/1965 | Carson | 172/719 |
| 3,477,520 | 11/1969 | Gray | 172/753 X |

*Primary Examiner*—Richard J. Johnson

*Attorney, Agent, or Firm*—Mattern, Ware, Davis & Stoltz

[57] ABSTRACT

By providing a plow and scraper blade assembly with a camming and securing member at one end and a pivotable, blade locking member at the other end, along with a cooperating, interfittingly engageable plow blade, a plow and scraper blade assembly is achieved wherein the plow blade is easily and quickly installable and removeable. In the preferred embodiment, a blade nesting and engaging channel is incorporated along with a plurality of stiffening ribs spaced along the channel to provide rigidity to the plow blade while enhancing the blade's rapid installation and removal qualities.

10 Claims, 4 Drawing Figures

FIG. 1
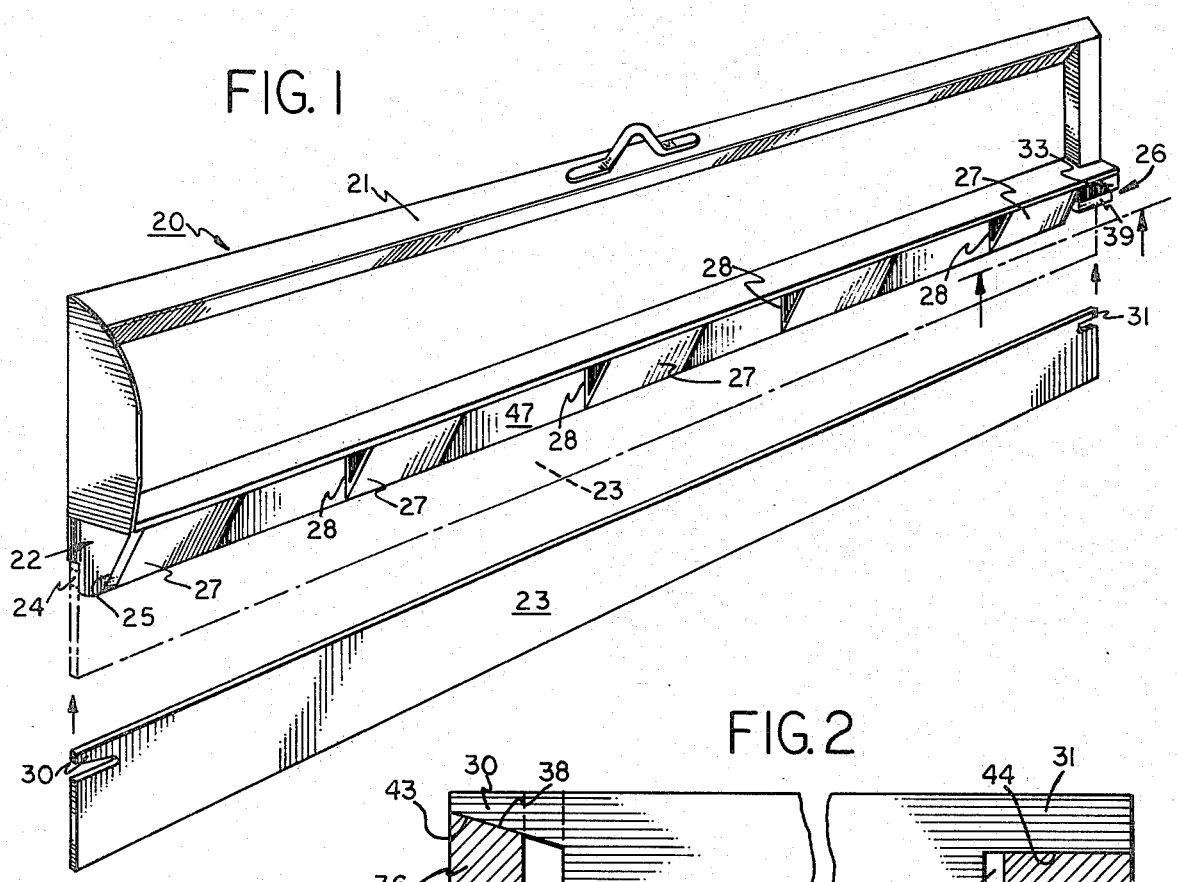
FIG. 2
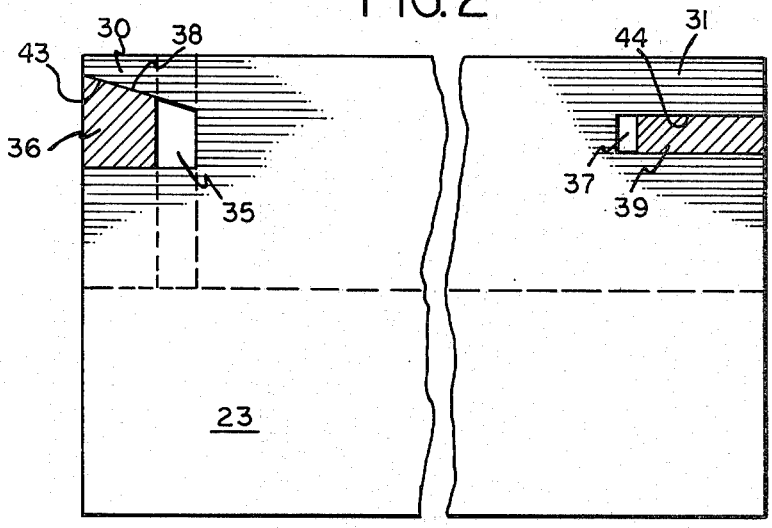
FIG. 4
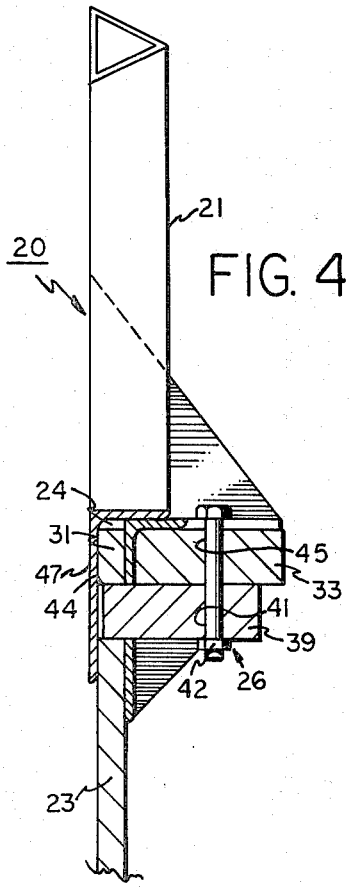
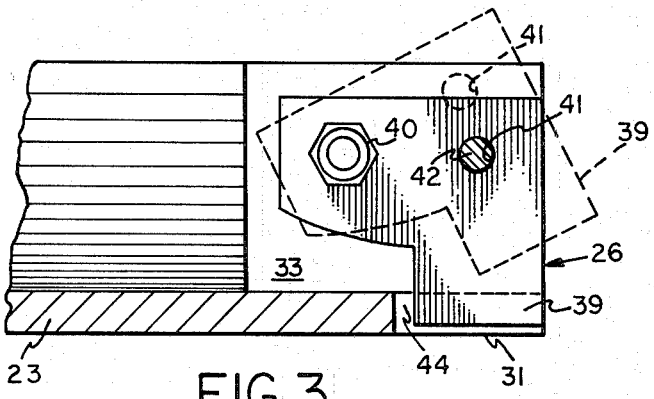
FIG. 3

SNOW PLOW BLADE ATTACHMENT SYSTEM

BACKGROUND OF THE INVENTION

This invention relates to plow and scraper assemblies and more particularly to plow and scraper assemblies having blades detachably removable from the mould board.

Generally, when plow and scraper assemblies are used for the removal of snow or ice or for the leveling of road surfaces, the scraper blades are easily damaged or worn down, necessitating repair or replacement. Since it is cumbersome and unrealistic to remove an entire plow or scraper assembly from the vehicle each time the blade must be removed, the plow and scraper assemblies incorporate detachable blades.

These prior art detachable blades are almost universally secured to the plow body or mould board of the plow assembly with a plurality of bolts. However, the use of fastening bolts has been found to be expensive as well as dangerous. The most severe problems exist with plow assemblies used for snow and ice removal, since the bolts become rusted, corroded, and difficult to remove.

Generally, it is necessary to cut, break, or burn the bolts off in order to remove the blade. This necessitates spending a great deal of manual effort. Furthermore, the incidence of injury during the removal of the blades was quite high, since force is typically required to dislodge the bolts, resulting in the shattering and aerial propelling of portions of the bolts.

Although various prior art systems have been developed in an attempt to eliminate the difficulties inherent in the use of bolts, no system has been developed which matches the ease of operation and secure, repeatable locking attachment of the present invention.

The following is a list of prior art references which are believed to be pertinent:

| U.S. Pat. No. | Issue Date | Inventor |
|---|---|---|
| 3,477,520 | 11/11/69 | J. J. Gray |
| 3,202,226 | 8/24/65 | C. W. Carson |
| 3,190,018 | 6/22/65 | M. P. Nelson |
| 3,090,140 | 5/21/63 | V. E. Trana |
| 1,741,933 | 12/31/29 | J. H. Gunnison |
| 1,885,231 | 11/1/32 | L. L. Chong et al |

Gray, U.S. Pat. No. 3,477,520, employs a plurality of horizontal slots in the plow body, coupled with wedge blocks mounted to the plow blade which interfit with the slots in the plow body. This greatly increases the cost of the manufacture of the plow blade and the plow body. Carson, U.S. Pat. No. 3,202,226, uses a complicated system of interlocking trapezoidally shaped wedges mounted on the plow blade which fit into similarly shaped sockets in the plow body. Further reinforcement and securing members are necessary in order to hold the plow blade securely in position. Nelson, et. al, U.S. Pat. No. 3,190,018, also teaches the use of lugs mounted on the plow blade that fit through slots in the plow body. Apertures in the lugs are designed to receive a tapered bar which acts to pull the blade in tight abutment with the plow body. This invention also involves much expense in manufacture.

Trana, U.S. Pat. No. 3,090,140, utilizes an aperture cut into the plow body to receive the plow blade. The blade is held in place by frictional means. Gunnison, U.S. Pat. No. 1,741,933, also uses projections mounted on the plow blade to interfit with flanges on the plow body. Cotter keys are used as attachment means in the Gunnison invention. Finally, Chong, U.S. Pat. No. 1,885,231, teaches the use of a slotted screw attachment system for mounting a small blade onto a garden tool structure.

Although these various prior art attempts have been made to provide an inexpensive and reliable blade securement system, these prior art systems have failed, and only produced a variety of expensive, cumbersome constructions which do not overcome the continuing problems of ease of installation and removal, low manufacturing costs, simplicity of operation, and secured engaged attachment of the plow blade to the plow body.

Therefore, it is a principal object of this invention to provide a plow and scraper assembly in which the plow blade is quickly and easily installable and removeable from the plow body or mould board.

Another object of this invention is to provide the plow and scraper assembly having the characteristic features defined above wherein the plow blade remains in secured engagement with the mould board throughout its use when mounted therewith.

Another object of this invention is to provide the plow and scraper assembly having the characteristic features defined above wherein both the plow blade and plow assembly are inexpensively manufactured and capable of operative use with a minimum of effort.

Other and more specific objects will in part be obvious and will in part appear hereinafter.

SUMMARY OF THE INVENTION

The plow body and blade assembly of the present invention overcomes all of the prior art problems by providing a plow blade and mould board construction which completely eliminates the time-consuming and difficult operations required in the prior art systems. In the present invention, the plow blade is easily installable on and removable from the mould board, as well as securely held in place during its operative use. Further, the plow blades and mould boards are easily and inexpensively manufactured, while existing mould boards are quickly and easily convertible to the system of the present invention.

In the present invention, the mould board of the plow body incorporates an elongated blade support assembly having a plow blade camming and securing portion at one end thereof, a plow blade engaging and locking portion at the other end thereof and an elongated blade receiving and nesting channel. In the preferred embodiment, a plurality of reinforcing, stabilizing members are disposed along the length of the channel to provide stiffening and securing support to the blade when mounted in position. The plow blade preferably is a conventional elongated rectangular shape with a cam cooperating flange and recess at one end and a slot formed in the other end. The cam cooperating flange and recess of the blade is constructed for cooperative pivoting and sliding inter-connection with the camming and securing portion of the blade support assembly.

In operation, the plow blade of the present invention is quickly and easily installed and securely engaged with the blade support assembly of the present invention by first inserting the flange formed at one end of the blade into the camming and securing portion of the blade support assembly. Then, the blade is pivoted and cammingly slid along camming and securing portion until the blade is in abutting contact with the blade receiving and nesting channel of the blade support assembly. The installation is then easily and quickly completed by pivoting the blade engaging and locking member of the blade support assembly into secure, locking engagement with the slot formed at the opposite end of the plow blade. The plow blade is then completely locked in this secure engaged position by inserting a bolt or similar fastening means into the pivoting, blade engaging and locking member.

In order to remove the blade, only the single fastener is removed. This allows the blade engaging and locking member to pivot into its open position, thereby allowing the plow blade to drop from its normal position and be quickly and easily withdrawn from the camming and securing portion of the blade support assembly. The blade may then be sharpened, repaired or replaced as desired and easily reinstalled in the blade support assembly.

The invention accordingly, comprises a structure possessing the features and properties which will be exemplified in the structures hereinafter described and the scope of the invention will be indicated in the Claims.

THE DRAWINGS

For a fuller understanding of the nature and objects of the present invention, reference should be made to the Detailed Description, taken in connection with the accompanying drawings in which:

FIG. 1 is an exploded perspective view of a plow and scraper assembly constructed according to the teachings of the invention.

FIG. 2 is a cross-sectional front elevation view, partially broken away, of the plow blade of the present invention taken along line 2—2 of FIG. 1.

FIG. 3 is a cross-sectional bottom plan view, partially broken away, of the plow and scraper assembly taken along line 3—3 of FIG. 1.

FIG. 4 is a cross-sectional side elevational view, partially broken away, of the plow and scraper assembly of FIG. 1 taken along line 4—4.

DETAILED DESCRIPTION

In FIG. 1, plow and scraper unit 20 is shown having a mould board 21, a blade support assembly 22, and a plow blade 23. Mould board 21 is adapted for mounting to any type of vehicle and incorporates blade support assembly 22 mounted thereto along the lower edge thereof. Blade 23 is shown removed from blade support assembly 22, with the locked, securely engaged position of blade 23 in support assembly 22 shown in phantom.

Blade support assembly 22 of this invention comprises a blade camming and holding member 25 mounted at one end of mould board 21 and a blade engaging and locking system 26 mounted to the other end of mould board 21. As shown in FIG. 2, blade camming and holding member 25 comprises camming and holding surface 38 for cooperative sliding, camming and holding engagement with blade 23.

In the preferred embodiment, camming and holding surface 38 extends longitudinally downwardly and comprises the upper, slanting surface of a substantially trapazoidally shaped boss 36. Of course, boss 36 may comprise any desired shape, however, the downwardly ramped camming and sliding surface 38 is preferably incorporated into boss 36 as the top surface thereof.

As best seen in FIGS. 3 and 4, blade engaging and locking system 26 incorporates a blade locking and engaging arm 39 and a supporting plate 33. Plate 33 is preferably, permanently mounted to mould board 21 and locking and engaging arm 39 is pivotally secured to plate 33. In the preferred embodiment, bolt 40 interconnects arm 39 with plate 33 while also assuring free pivoting movement of arm 39 about the axis defined by bolt 40. As is fully described below, the free pivoting of arm 39 assures the quick and easy secure locking engagement of blade 23.

In order to assure the secure, locked retention of blade 23 in its engaged position, arm 39 incorporates a locking hole 41 and plate 33 incorporates a similarly dimensioned, axially aligned locking hole 45. When locking holes 41 and 45 are axially aligned, bolt means 42 is inserted therethrough in order to assure secure locked retention of arm 39 in its blade engaged position. As should now be clear from this discussion, the blade locking and engaging system of this invention provides ease of installation and secure, locked engagement of a plow blade using only a single bolt.

In the preferred embodiment, blade support assembly 22 also incorporates a blade receiving channel 24 longitudinally disposed along the lower edge of mould board 21. Channel 24 is formed between a forwardly positioned, elongated blade-containing lip member 47 and a plurality of stiffening ribs 27, each of which comprises a blade engaging surface 28. As best seen in FIG. 4, channel 24 contains blade 23 between lip member 47 and ribs 27 in order to eliminate or substantially reduce the front-to-back movement of blade 23 during use. Furthermore, ribs 27 impart additional stiffening to blade 23 along its entire length.

As best seen in FIGS. 1 and 2, plow blade 23 of this invention is shown as comprising an elongated, substantially rectangular structure incorporating, at one end thereof, a camming, sliding and holding surface 43 formed on a flange 30. The other end of the plow blade 23 incorporates a flange 31 which comprises an arm engaging surface 44 and defines a locking arm engaging slot 37.

In the preferred embodiment, camming, sliding, and holding surface 43 comprises the lower edge of flange 30 and is downwardly slanted from the edge of blade 30 inwardly toward the center of blade 30. Camming and holding surface 43 also defines a recess 35 which is dimensioned for cooperative interconnection with boss 36 of blade support assembly 22. Although any flange and camming and holding surface construction can be employed without departing from the scope of this invention, the downwardly slanted, longitudinally extending surface is preferred in order to assure ease of installation and secure holding retention with manufacturing ease.

Flange 31 formed on the opposite end from flange 30 preferably incorporates arm engaging surface 44 as its lower edge, with surface 44 defining arm engaging slot 37. Arm engaging slot 37 is dimensioned for cooperative, securely engaged positioning of arm 39 in slot 37. Although any shape can be employed, a substantially rectangular recess 37 is preferred, as well as a substantially flat rectangular arm 39. This construction is preferred for manufacturing simplicity.

By referring to FIGS. 1, 3 and 4, the installation assembly and operation of the plow and scraper assembly will now best be understood. Plow mould board 21 is normally attached to a truck or similar vehicle for use in snow removal or road leveling. Since it is quite cumbersome and difficult to remove the entire plow blade assembly from the vehicle, it is advantageous to have an easily and rapidly installable and removeable plow blade.

The plow blade 23 of the present invention provides such easy attachment and removal. Plow blade 23 is mounted by first placing flange 30 into contact with boss 36 so that camming and sliding surface 43 is in sliding engagement with camming and holding surface 38 of boss 36. The opposite end of the blade 23 is free to rest on the ground to facilitate ease in mounting.

The camming and sliding surface 43 of the blade 23 is then slidingly advanced along the camming and holding surface of boss 36, while simultaneously lifting and upwardly pivoting the free end of the blade 23. This sliding and pivoting movement is continued until flange 30 is securely engaged with boss 36 and blade 23 is nested within the blade receiving channel 24. As discussed above, the shape of boss 36 and slot 35 are alterable, however, boss 36 and slot 35 should be constructed for cooperative interconnection and secured camming engagement and holding of blade 23 about boss 36 with the upper portion of blade 23 firmly positioned within the blade receiving channel 24.

The secure locking engagement of blade 23 in blade support support system 22 is completed by pivoting blade locking and engaging arm 39 about the pivot axis of bolt 40 into locking engagement within the locking recess 37 and abutting contact with surface 44 of flange 31 of blade 23. Bolt 42 is then inserted through aligned holes 41 and 45, and fastened in place. In this way, blade locking and engaging arm 39 is secured in position, assuring that blade 23 is firmly and securely engaged in position within the blade receiving channel 24.

During operation, the support members 27 of the blade support assembly 22 provide added support to blade 23, imparting a stiffening effect to blade 23. This provides added assurance that the blade's structural integrity is maintained and that the blade provides trouble-free operation.

When the blade 23 becomes dull or damaged, the bolt means 42 are easily removed, allowing the pivotable, blade locking and engaging arm 39 to be moved out of engagement with the recess 37 and flange 31 of the blade 23. Then, flange 30 of blade 23 is quickly withdrawn from engagement with the boss 36, by merely reversing the camming and sliding insertion discussed above, and complete removal of blade 23 from blade support assembly 22 is achieved.

From the teaching of this disclosure, it is clear that the uncomplicated construction of blade 23 and the unique construction and arrangement of blade support assembly 22 which combine to form blade and scraper unit 20 of this invention attains heretofore unreachable goals. In particular, the present invention assures ease of manufacture, assembly, installation, and maintenance, thereby keeping costs at a minimum while providing a greatly improved product.

It will thus be seen that the objects set forth above, among those made apparent from the preceding description, are efficiently attained and, since certain changes may be made in the above product without departing from the scope of the invention, it is intended that all matter contained in the above description or shown in the accompanying drawings shall be interpreted as illustrative and not in a limiting sense.

It is also to be understood that the following claims are intended to cover all the generic and specific features of the invention herein described, and all statements of the scope of the invention which, as a matter of language, might be said to fall therebetween.

Having described my invention, what I claim as new and desire to secure by Letters Patent is:

1. A plow and scraper unit, adapted for mounting to a vehicle comprising:

(A) a generally elongated, rectangular mouldboard;

(B) a blade support assembly securely mounted along the lower edge of the mouldboard and incorporating (a) a downwardly opening elongated blade securing and positioning channel extending along the lower edge of the mouldboard for receiving a plow blade therein, (b) a blade camming and securing member (1) mounted at one end of the lower surface of the mouldboard in substantial planar alignment with the channel, and (2) incorporating a blade engaging and camming surface for cooperative sliding and upward camming and holding engagement with a portion of a plow blade, and (c) a transversely movable blade locking member mounted on the other end of the lower edge of the mouldboard; and (C) a plow blade having an elongated substantially rectangular planar shape and incorporating (a) a camming and sliding surface integrally formed along one end thereof for cooperative interconnection and upward sliding engagement with the blade camming and securing member of the support assembly, and (b) a lock engaging recess integrally formed in the other end of the blade for cooperative, locking and secure engagement with the transversely movable blade locking member of the support assembly;

whereby the plow blade is quickly and easily installable and removable from the plow blade support assembly by inserting one end of the blade into the channel and advancing the camming and sliding surface of the blade with the cooperating camming and securing member of the support assembly into its completely engaged position then raising the opposite end of the blade into the channel and then merely moving the blade locking member into secure engagement with the blade, lock engaging means thereby assuring secure interconnection and engagement of the plow blade in position ready for operation, without using threaded fasteners directly engaging the blade.

2. A plow and scraper unit as defined in claim 1 wherein said elongated blade securing and positioning channel extends from the blade camming and securing member to the blade engaging and locking member.

3. A plow and scraper unit defined in claim 2, wherein said channel is further defined as comprising:

(1) a forward vertically depending flange member extending substantially the entire length of the mould board and positioned for secure abutting contact with the top forward surface of the plow blade, and (2) a plurality of blade support ribs positioned at spaced intervals along the entire length of the mould board each of which having a blade engaging surface for substantial abutting contact with the top rear surface of the blade, forming the rear portion of a channel and providing secure blade support and stiffening during use.

4. The plow and scraper unit defined in claim 1, wherein the lock engaging means of the plow blade comprises a recess formed along the edge of the blade and the blade engaging and locking member of the blade support assembly comprises a pivotable arm (1) mounted to the blade support assembly, and (2) positioned for rapid pivoted, secure locking engagement in the recess formed in the blade.

5. The plow and scraper unit defined in claim 4, wherein the blade engaging and locking means further comprises fastening means engageable between the pivotable arm and the mould board, for securely locking the pivotable arm in its blade engaged position, thereby assuring secure engaged retention of the plow blade when mounted therewith.

6. The plow and scraper unit defined in claim 1, wherein the plow blade is further defined as comprising two flanges formed at opposite ends thereof with the first flange incorporating the camming and sliding surface as its lower edge and the second flange defines the plate engaging recess as its lower edge.

7. The plow and scraper unit defined in claim 6, wherein the camming and sliding surface of the first flange is further defined as comprising a longitudinally downwardly extending surface.

8. The plow and scraper unit defined in claim 7, wherein the blade camming and securing member of the blade support assembly comprises a longitudinally downwardly extending surface as its upper surface for cooperative interconnection and sliding camming engagement with the lower surface of the first flange.

9. A snow plow blade support assembly for mounting to the mouldboard of a plow body and securely holding and supporting a snow plow blade installed therewith, comprising:

(A) a downwardly opening elongated blade nesting and engaging channel (B) a blade camming and securing member (a) mounted within and inwardly of one end of the channel in substantial planar alignment therewith, and (b) incorporating a longitudinally, downwardly extending surface for cooperative sliding and upward camming and holding engagement with a portion of the plow blade; and (c) a blade engaging and locking member mounted on the other end of the channel and incorporating (1) a movable arm secured to said assembly positioned for cooperative locking engagement with the plow blade, and (2) position securing means engageable with the movable arm and the support assembly for securely locking the arm in its blade engagement position.

10. A plow and scraper unit adapted for mounting to a vehicle comprising:

(A) a generally elongated rectangular mouldboard;

(B) a plow blade support assembly securely mounted along the lower edge of the mouldboard and incorporating (a) a downwardly opening elongated blade securing and positioning channel extending along the length of the lower edge of the mouldboard and adapted for nesting receipt of the plow blade therein and secure retention thereof, and (b) blade side end engaging members adapted for engaging, capturing and securely maintaining the plow blade in position, said side end engaging members being (1) mounted to the lower edge of the mouldboard at opposed ends thereof in cooperative position and spaced planar alignment with the elongated channel (2) a first of said blade side end engaging members comprising a blade camming and securing member for cooperative sliding and upward camming engagement with one side of the blade, and (3) the second of said blade side engaging members comprising a movable blade engaging and locking member for rapid engagement and disengagement with the opposed end of the blade; and (C) a plow blade having an elongated substantially planar rectangular shape and incorporating (a) a camming and sliding surface integrally formed in one end thereof for cooperative interconnection and upward sliding engagement with the blade camming and securing member of the support assembly and (b) a locking engaging recess integrally formed in the other end of the blade for cooperative locking and secure engagement with the movable blade locking member of the support assembly;

whereby the plow blade has only side end engagement recesses and is quickly and easily installable and removable from the plow blade support assembly by inserting one end of the blade into the channel and advancing the camming and sliding surface of the blade with the cooperating camming and securing member of the support assembly into its completely engaged position then raising the opposite end of the blade into the channel and then merely moving the blade locking member into secure engagement with the blade, thereby assuring secure interconnection and engagement of the plow blade in position ready for operation, without using threaded fasteners directly engaging the blade and eliminating the need for a plurality of apertures along the length of the blade.

* * * * *